United States Patent [19]

Kirkpatrick

[11] 4,188,257

[45] Feb. 12, 1980

[54] WEB HANDLING APPARATUS

[75] Inventor: Alan D. Kirkpatrick, Martinsville, N.J.

[73] Assignee: Corrugated Development, Inc., Fairfield, N.J.

[21] Appl. No.: 871,557

[22] Filed: Jan. 23, 1978

[51] Int. Cl.[2] ..... B65H 19/08; B65H 19/16

[52] U.S. Cl. ..... 156/504; 242/58.4

[58] Field of Search ..... 156/504, 505; 242/58.4, 242/58.1, 58.3

[56] References Cited

U.S. PATENT DOCUMENTS

| | | | |
|---|---|---|---|
| 3,089,661 | 5/1963 | Phillips | 156/504 |
| 3,896,820 | 7/1975 | Ludszeweit | 156/504 |

*Primary Examiner*—Douglas J. Drummond

*Attorney, Agent, or Firm*—Carella, Bain, Gilfillan & Rhodes

[57] ABSTRACT

Apparatus for handling webs of material is disclosed in the context of a web joining apparatus. The leading edge of a fresh web of material is positioned either above an active web or below an active web and, upon imminent exhaustion of the active web, is accelerated to the speed of the active web to be joined thereto to define a continuous web of material. Acceleration is achieved through a clutch means which is driven by the active web and which is adjustable to achieve the desired acceleration in the space provided without exceeding the tensile strength of the web being accelerated.

27 Claims, 15 Drawing Figures

WEB HANDLING APPARATUS

BACKGROUND OF THE INVENTION

This invention relates generally to the field of web feed devices. More specifically, the invention relates to apparatus for accelerating a first web of material to the velocity of a moving second web of material and finds particularly utility for joining the leading edge of a fresh web of material to the trailing edge of an expiring web of material without interrupting the continued advance of the expiring web.

There are many manufacturing operations wherein most efficient utilization of raw materials and equipment requires the manufacturing operation to be conducted on a continuously moving web. Because there is no such thing as an endless supply of raw material, particularly rolled material such as paper, cardboard, kraft, floor coverings and the like, it has been a course of continuing concern to those skilled in these arts as to the best manner in which to connect the trailing edge of one roll of material being utilized in a production process with the leading edge of a next subsequent roll of material to be utilized in the manufacturing process.

Some industries have found the problem to be incapable of being solved on an economically sound basis and have been resigned to the necessity of terminating manufacturing operations while the next succeeding roll of raw material is connected to the roll of raw material in the process of exhaustion in the apparatus.

Other industries have been able to justify equipment for splicing a fresh web to an expiring web without requiring termination of the manufacturing process. In this regard, the most oft used form of apparatus for permitting splicing without interruption of the advance of the active web through the production line is called an accumulator. Such an accumulator gathers in-feed web material, e.g. by providing a mechanically adjustable tortuous path, and stores the excess length of in-feed material until such time as it is desired to make a splice. Upon the occurrence of the time for splicing, the trailing end of the active web is clamped and the accumulator is permitted to unload its excess material thus permitting the trailing end to remain stationary while being spliced to the fresh web while at the same time permitting the operation of the production line to be maintained. As is well known by those skilled in the arts, such accumulator apparatus is expensive, difficult to maintain and often times difficult to operate.

Another approach to providing a splice with respect to moving web materials without requiring shut down of an associated production line has been to mount the rolls of fresh web material on mounting devices which are rotatable. The theory of such splicing devices which utilize rotatable web support means is that a fresh web must always be positioned on top of an expiring web during splicing. With a fresh web leading edge being always on the top position for in-feed into the apparatus, many of the problems oridinarily attendant to attempts to splice moving webs are overcome. It is well recognized in these arts, however, that the rotating web support devices are expensive and further, in many existing applications, they are incapable of use because there is insufficient room for their installation in the space available.

In this regard, it should be noted that there are numerous manufacturing facilities presently operated in the United States and other countries wherein the web material is being fed through a production line and wherein shut down of the line is required for purposes of splicing a fresh web to an expiring web. With respect to such installations, there is presently no splicing equipment available which is small enough to fit within the confines of the available space and sufficiently inexpensive to justify incorporation in existing manufacturing operations.

The present invention, therefore, addresses itself not only to novel structure for achieving a splice between two moving pieces of web material but also to providing apparatus for achieving such a splice which is capable of justifiable incorporation in presently existing equipment.

SUMMARY OF THE INVENTION

It is an object of the present invention, therefore, to provide apparatus for accelerating one web of material to achieve the velocity of an adjacent moving web of material such as to cause the two webs to come into surface-to-surface engagement with zero relative movement.

It is a further object of the present invention to provide a web advancing apparatus which is particularly useful as a web splicing apparatus which permits splicing of the leading edge and trailing edge of fresh and expiring web materials, respectively, while the web materials, and in particular the area of the splice, are being advanced into a production line facility.

Another object of the invention is to provide a web accelerating apparatus, for continuously advancing web materials, which is economical to construct.

A still further object of the present invention is to provide a web accelerating apparatus, particularly useful as a splicing apparatus for continuously moving web materials, which requires a minimum of space for installation and which is therefore compatible with existing web feed equipment.

Yet another object of the present invention is to provide a splicing apparatus for continuously advancing web materials wherein the leading end of the fresh web may be spliced to the trailing end of the expiring web either from the top surface of the expiring web or from the bottom surface of the expiring web.

A still additional object of the present invention is to provide a web accelerating apparatus for continuously moving webs wherein a new web may be accelerated from 0 speed to the web speed of an expiring web by the action of the expiring web and without exceeding the tensile strength limit of the web material being displaced.

These objects and others not enumerated are achieved by the web accelerating and splicing apparatus according to the present invention, one embodiment of which may include a first roller means for accommodating therebetween of a first web of material, second roller means for accommodating the passage therebetween of a second web of material, third roller means for accommodating the passage therebetween of either of the first web of material individually, the second web of material individually or the first and second webs of material together, and means responsive to the operation of the third roller means for driving the first roller means to accelerate the first web of material to the speed of the second web of material.

BRIEF DESCRIPTION OF THE DRAWINGS

A more complete understanding of the present invention may be had from the following detailed description, particularly when read in the light of the accompanying drawings wherein.

DETAILED DESCRIPTION

Figure 1:
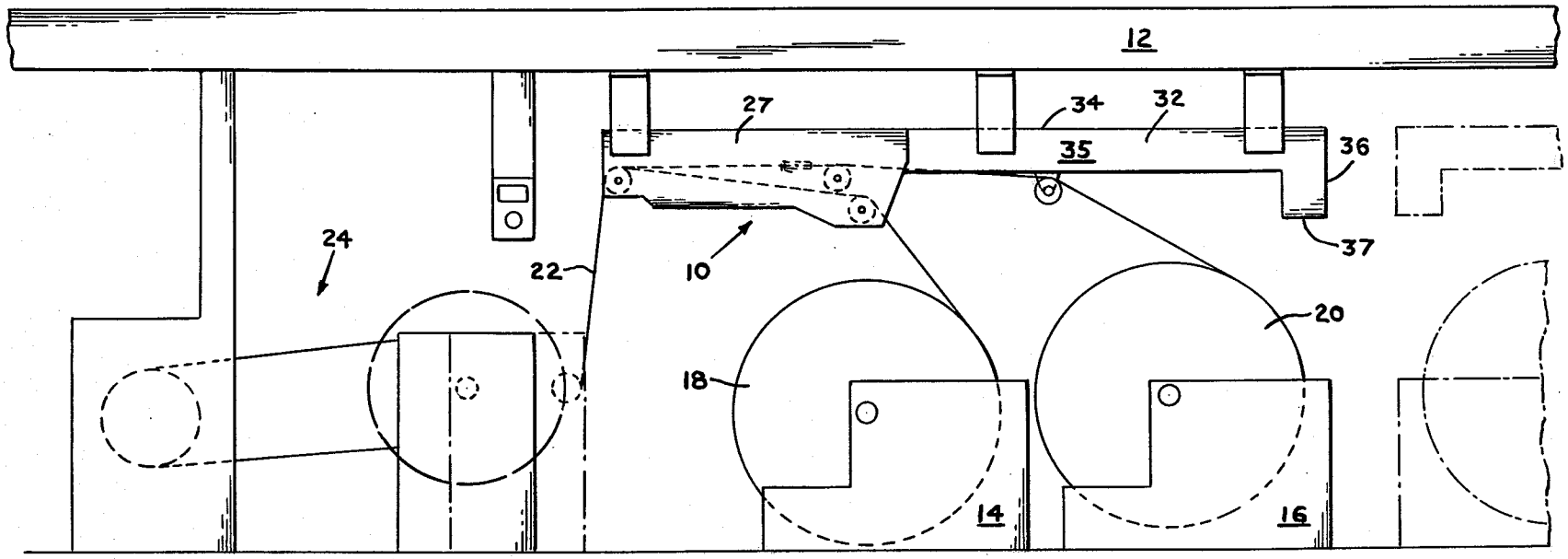
FIG. 1 is a front elevational view of apparatus according to the invention which is shown utilized to provided a continuous feed of web material to a manufacturing operation.

Referring therefore to FIG. 1 a web accelerating and joining apparatus structured according to the present invention is designated generally by the reference numeral 10. Web joining apparatus 10 is shown in use with a corrugated paper manufacturing line, only a portion of the line being shown by way of illustration.

Web joining apparatus 10 is shown to be suspended from overhead supports such as I-beams 12 or the like. It will be recognized, however, that the manner of suspension is not critical and therefore web joining apparatus 10 may be supported from suitable machine structural members, the floor or otherwise as may be deemed appropriate and desirable under the conditions experienced.

Web handling apparatus 10 operates in conjunction with a first spool feed structure 14 and a second spool feed structure 16. Each of first and second spool feed structures 14 and 16 includes a spool mounting structure for rotatably mounting rolls of web feed material, e.g. rolls 18 and 20. In the embodiment shown, the feed roll 18 on spool feed structure 14 will be the lower web feed roll and the feed roll 20 on second spool feed structure 16 will be the upper web feed roll. It will further be recognized that spool feed structures 14 and 16 are the type wherein a spent spool may be quickly removed and replaced by a fresh web feed roll within a period of time which is shorter than the time required to fully exhaust a fresh web feed roll. In this regard, such spool feed structures are well known in these arts and any of the many which are generally available may be used in conjunction with the web handling apparatus 10 of the present invention.

It will be recognized by those skilled in these arts that the purpose of web handling apparatus 10 is to join the trailing end of an expiring web of material with the leading end of a fresh web of material such that the manufacturing line which utilizes the feed of web material may be operated without interruption. Thus, referring to FIG. 1, if feed roll 18 is the "active" feed roll, i.e. the feed roll which is being unrolled and directed through the web handling apparatus and into the production line, the feed roll 20 will be the "ready" feed roll, i.e. the roll being prepared for joinder with the trailing end of the web from roll 18. Conversely, if feed roll 20 is the "active" feed roll, then feed roll 18 is the "ready" feed roll.

The web of material 22 which is being discharged from web handling apparatus 10 is utilized as an input web to production equipment, e.g. the finishing equipment shown in FIG. 1 and designated generally by the reference numeral 24. Such production equipment, however, forms no part of the present invention and is disclosed merely by way of context and not limitation.

Referring now to FIGS. 2 through 6, a web handling apparatus 10 according to the present invention is shown in a plurality of more detailed views. The basic structural elements of apparatus 10 are a first structural plate 27, a second structural plate 28 and a plurality of brace members 29. Each of the structural plates 27, 28 comprises a rigid steel plate which is positioned to extend generally longitudinally vertically. In this regard the term longitudinally as used with respect to apparatus 10 is intended to mean the direction corresponding to the direction of passage of web material through apparatus 10. Structural plates 27, 28 are spaced apart and rigidly secured together by the plurality of transversely extending braces 29. Brace members 29 may be any form of structural element however it has been found for purposes of the disclosed embodiment that steel bars having a pair of tapped bores in each end are suitable for use. The tapped bores are positioned to be aligned with bores formed in structural plates 27, 28. During assembly of the structural portions of apparatus 10, braces 29 are properly positioned and bolts 30 are passed through the bores in plates 27 and 28 and are threaded into the tapped bores of braces 29 to rigidly secure the structural members in the desired positions.

Figure 2:
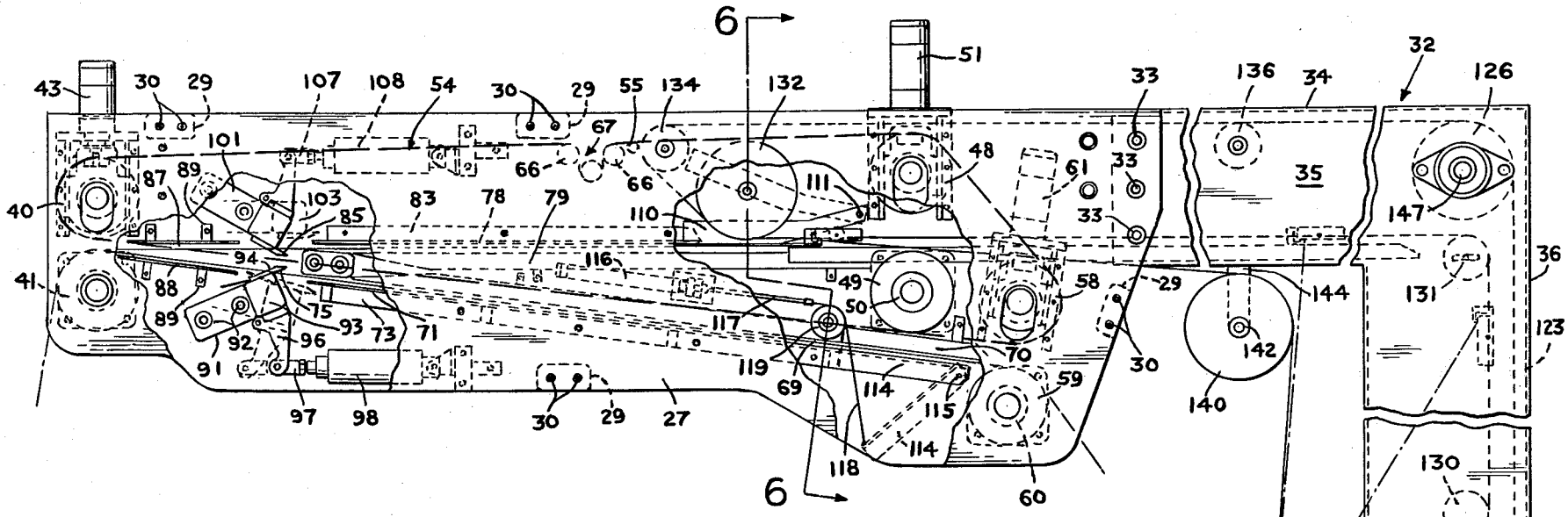
FIG. 2 is a front elevational view of apparatus according to the invention which is partially cut-away to show the operating mechanisms of the structure.

Rigidly secured to first and second structural plates 27, 28 is a web clamp casing 32. Web clamp casing 32 is a sheet metal casing which is secured to plates 27, 28 by securing means such as bolts 33 and which encases a top web feeding means as is discussed below in detail. In this regard, clamp casing 32 is an L-shaped member as seen in FIGS. 1 and 2 and includes a top wall 34, front 35 and back 38, side walls, an end wall 36 and a bottom wall 37 on the short leg of the L. The bottom of casing 32 is open to accommodate feeding of the leading edge of a fresh web all as discussed below.

Apparatus 10 includes structure for achieving three basic functions: top web feed positioning, bottom web feed positioning and web acceleration and splicing. To these ends, apparatus 10 is provided with a plurality of driving, driven and idler rollers as well as other structure which permits achievement of the functions and which are hereinbelow structurally described prior to a specific description of their functional and operational involvement.

Thus, apparatus 10 includes a pair of output rolls including an output nip roll 40 and an output idler roll 41. Output idler roll 41 is rotatably mounted between first and second structural plates 27, 28, such as by receipt within suitable bearing mounted on the inner surfaces of plates 27, 28. Output nip roll 40 is supported in suitable bearings 42 adjacent its ends, which bearings are mounted on the shafts of air motors 43. Air motors 43, which are rigidly secured to the inner surface of structural plates 27 and 28, operate to displace nip roll 40 between an operating position in which its surface tends to engage the surface of idler roll 41 and a retracted position in which the surface of nip roll 40 is displaced from the surface of idler roll 41. The shaft 44 on one end of nip roll 40 is elongated such as to extend through a suitable slot provided in second structural plate 28. As is discussed below in detail, shaft 44 extends through structural plate 28 to accommodate the mounting thereon of a clutch means 45 which, through an associated sprocket 46 drives other nip rolls in the bottom and top web feed system.

Similarly structured are a pair of top web input rolls and a pair of bottom web input rolls. Top web input rolls include a top web input nip roll 48 and top web input idler roll 49. Top web input idler roll 49 is rotatably mounted between first and second structural plates 27, 28 such as by receipt within suitable bearings 50 mounted on the inner surfaces of plates 27, 28. Top web input nip roll 48 is supported in suitable bearings adjacent its ends, which bearings are mounted on the shafts of a pair of air motors 51. Air motors 51, which are rigidly secured to the inner surfaces of structural plates 27 and 28, operate to displace nip roll 48 between an operating position in which its surface tends to engage the surface of idler roll 49 and a retracted position in which the surface of nip roll 48 is displaced from the surface of idler roll 49. The shaft 52 on one end of nip roll 48 is elongated such as to extend through a suitable slot provided in second structural plate 28. Shaft 52 so extends through plate 28 to accommodate the mounting thereon of sprocket 53 which is operatively driven by sprocket 46 through a chain 54 as is discussed below.

Also structured similarly to the output rolls and top web input rolls are a pair of bottom web input rolls. Bottom web input rolls include a bottom web input nip roll 58 and bottom web input idler roll 59. Bottom web input idler roll 59 is rotatably mounted between first and second structural plates 27, 28 such as by receipt within suitable bearings 60 mounted on the inner surfaces of plates 27, 28. Bottom web input nip roll 58 is supported in suitable bearings adjacent its ends, which bearings are mounted on the shafts of a pair of air motors 61. Air motors 61, which are rigidly secured to the inner surfaces of structural plates 27 and 28, operate to displace nip roll 58 between an operating position in which its surface tends to engage the surface of idler roll 59 and a retracted position in which the surface of nip roll 58 is displaced from the surface of idler roll 59. The shaft 62 on one end of nip roll 58 is elongated such as to extend through a suitable slot provided in second structural plate 28. Shaft 62 so extends through plate 28 to accommodate the mounting thereon of sprocket 63 which is operatively driven by sprocket 46 through chain 54 as is discussed below in detail.

Figure 3:
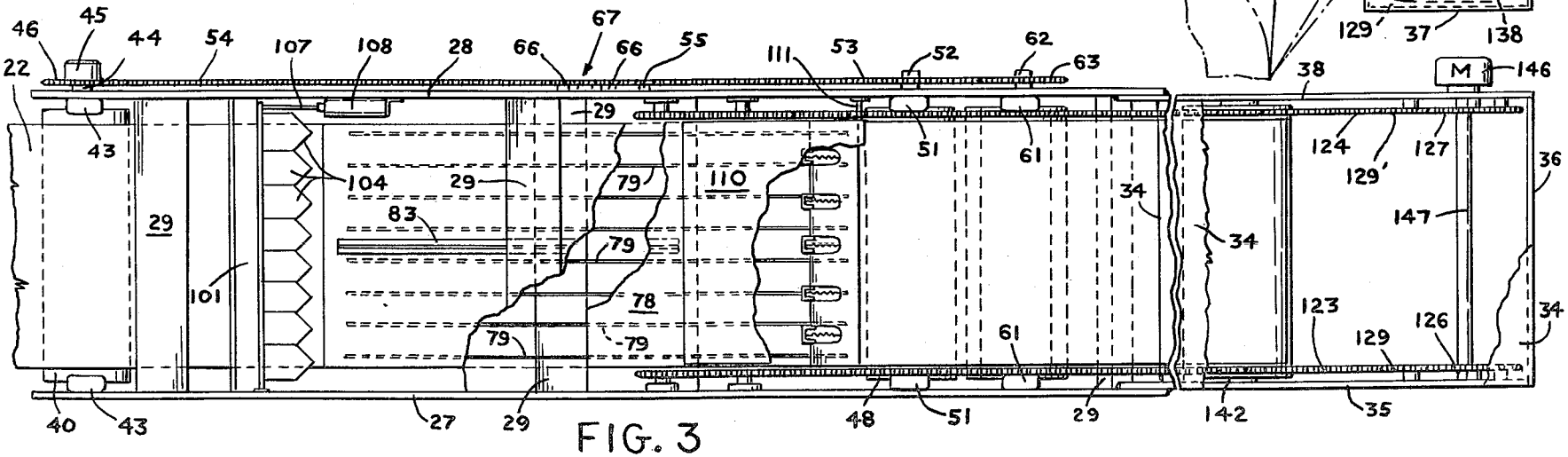
FIG. 3 is a plan view of the apparatus of FIG. 2.
Figure 4:
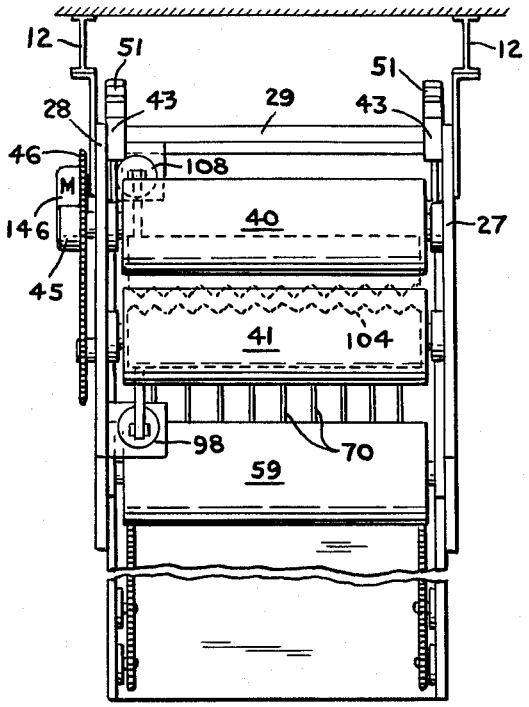
FIG. 4 is a left end view of the apparatus of FIG. 2.
Figure 5:
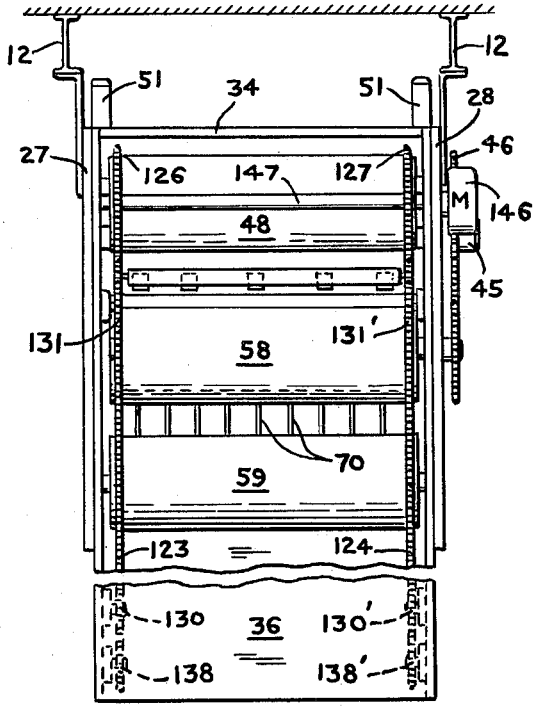
FIG. 5 is a right end view of the apparatus of FIG. 2.
Figure 7:
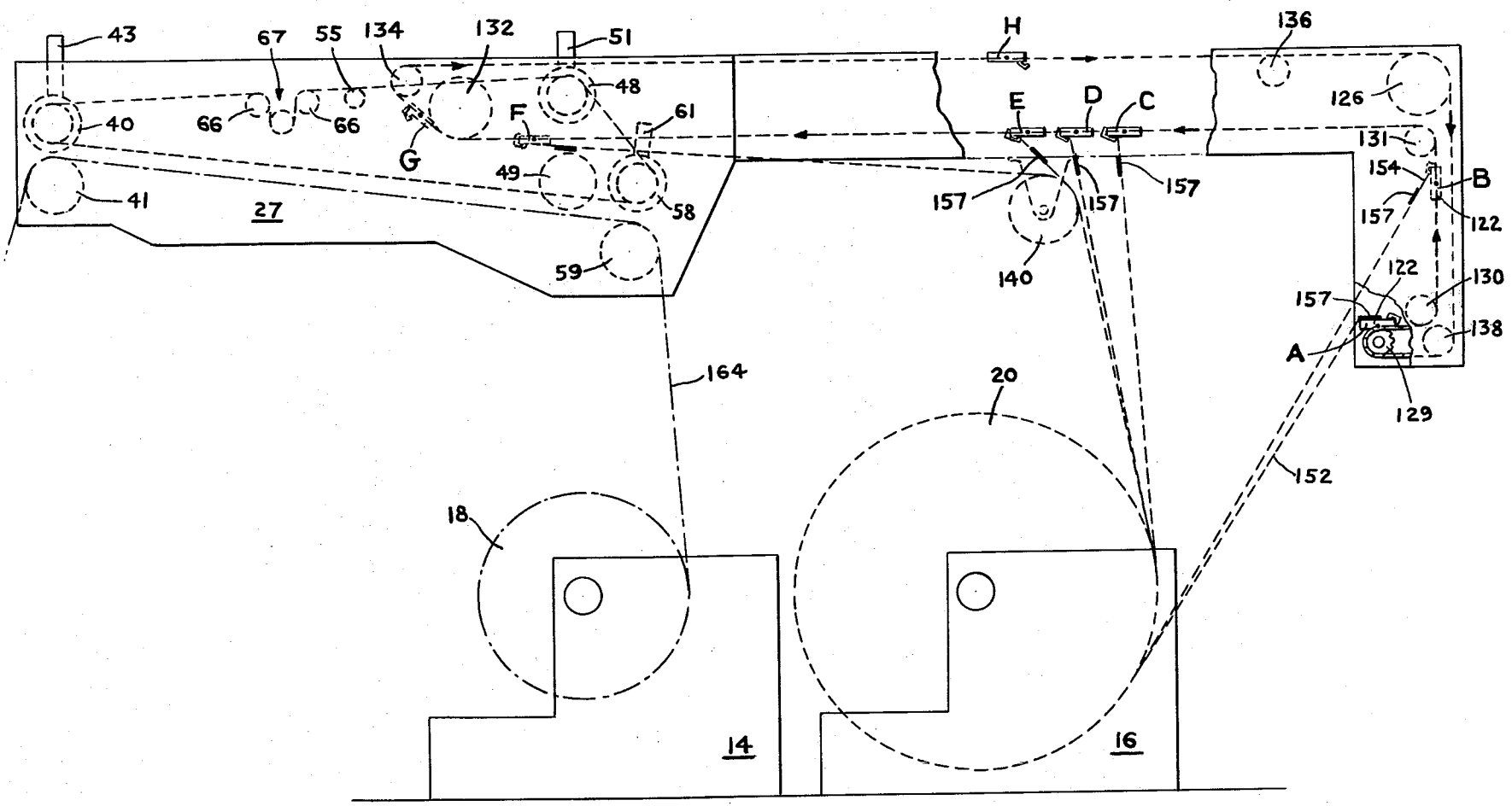
FIG. 7 is a front elevational schematic view of the top web positioning structure according to the invention for positioning the leading edge of a fresh top web of material in anticipation of acceleration and splicing.

As best may be seen in FIGS. 3 and 7, roll drive chain 54 enages sprockets 66 of an accumulator 67. As will be recognized by those skilled in these arts, accumulator 67 is provided to accommodate for the changes in the effective length of chain 54 in response to the movements of the various nip rolls 40, 48 and 58 between operational and retracted positions. Accumulator 67 may be any of the many generally known in these arts and may be rigidly secured to the external surface of second structural plate 28.

The imaginary plane which extends between the upper surface of output idler roll 41 and top web input idler roll 49 basically defines the plane of advance of a web of material passing therebetween. Similarly, the imaginary plane which extends between the upper surface of output idler roll 41 and bottom web input idler roll 59 basically defines the plane of advance of a web of material passing therebetween. In this regard web material passing through apparatus 10 between the top and bottom web input rolls and the output rolls is restrained generally within the desired planes of advance by the cooperation of guide bars and support plates which best may be described with reference to FIGS. 2 and 6.

Figure 6:
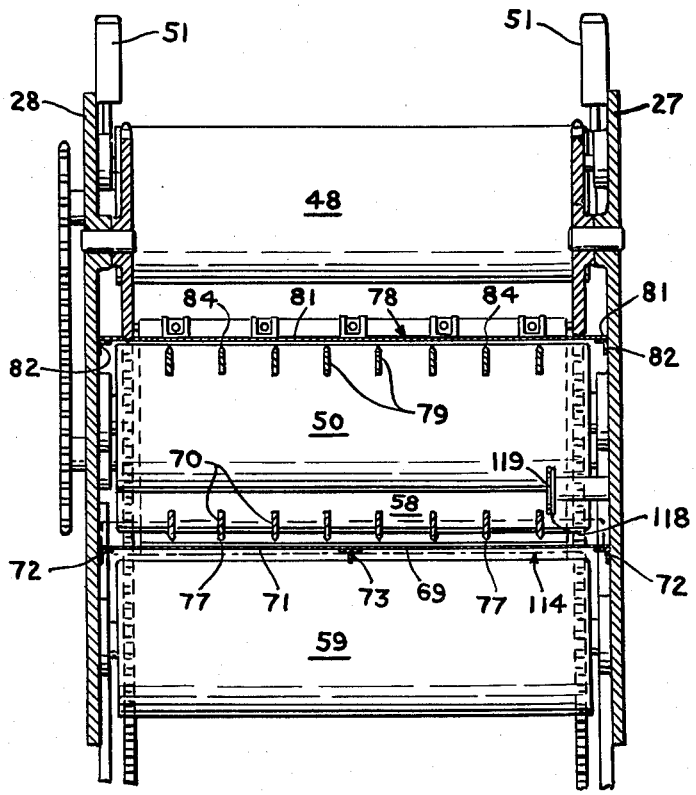
FIG. 6 is a cross-sectional view through the plane 6—6 of FIG. 2.

Considering therefore the plane between the lower web input rolls and the output rolls and with particular reference to FIG. 6, there can be seen a support plate 69 and a plurality of guide bars 70. Support plate 69 may comprise a sheet 71 of metal which extends transversely across apparatus 10 between the inner surfaces of first and second structural plates 27, 28. Sheet 71 is provided with edge stiffeners 72 at each longitudinally extending edge and a longitudinally extending centrally disposed stiffener 73 substantially midway between plates 27 and 28. Edge stiffeners 72 may be angle iron or other suitable material and may be provided with spaced bores to accommodate securing to the sheet 71 and also to provide for being secured to plates 27 and 28 such as by machine screws and the like. Central stiffener 73 is a T-bar shape and may be secured to sheet 71 by spot welding, riveting or other suitable methods all of which are known to those having skill in these arts. Guide bars 70 are elongated metal bars which extend longitudinally from the discharge side of the bottom web input rolls to a position just short of lower web cutting knife 75. As best may be seen in FIG. 6, the bottom surface of each of guide bars 70 is machined to define a knife edge 77. Knife edge 77 extends throughout the length of each bar 70 and is provided to reduce the surface area subject to contact with the upper surface of an advancing bottom web, all as is discussed below in detail. Transverse spacing of bars 70 is achieved by transversely extending spacer elements which position the bars as desired and which also are rigidly secured at their ends to structural plates 27, 28 such as to maintain the bars is proper position within apparatus 10.

With respect to the plane between the upper web input rolls and the output rolls, and referring to FIGS. 2 and 6, there can be seen a support plate 78 and a plurality of guide bars 79. An examination of FIG. 6 to compare support plate 69 and guide bars 70 with support plate 78 and guide bars 79 clearly shows that the relationship of the parts is reversed. Thus the knife edges of guide bars 70 face downwardly whereas the knife edges of guide bars 79 face upwardly. This relationship has a purpose and, as is discussed below, provides for passage of web material with a minimum amount of surface contact area in the surfaces defined by the guide bars.

Considering the specific structure of support plate 78, support plate 78 can be seen to comprise a sheet 81 of metal which extends transversely across apparatus 10 between the inner surfaces of first and second structural plates 27, 28. Sheet 81 is provided with edge stiffeners 82 at each longitudinally extending edge and a longitudinally extending, centrally disposed stiffener 83 (FIG. 2) substantially midway between plates 27 and 28. Edge stiffeners 82 may be angle iron or other suitable material and may be provided with spaced bores to accommodate securing to sheet 81 and also to provide for being secured to plates 27, 28 such as by machine screws and the like. The central stiffener for sheet 81 may be a T-bar and may be secured to sheet 81 by spot welding, riveting or by other suitable methods all of which are known to those having skill in these arts. Guide bars 79 are identical in construction to guide bars 70, i.e. they are elongated metal bars which are machined to provide knife edges 84 thereon. The length of guide bars 79 is such as to permit them to extend from the discharge side of the top web input rolls to a position just short of upper web cutting knife 85.

Referring specifically to FIG. 2, it can be seen that the path of travel of top and bottom webs, between cutting knives 75 and 85 and the output rolls is limited by an upper guide plate 87 and lower guide plate 88. Upper and lower guide plates 87, 88 comprise sheet metal elements which extend transversely between structural plates 27, 28 and which are rigidly secured thereto such as by tabs 89 with machine screws extending therethrough into appropriate tapped openings in plates 27, 28.

The structure of lower and upper cutting knife elements 75, 85 is substantially identical. Considering lower cutting knife structure 75, there is provided a transversely extending structural brace member 91 which is secured at its ends to plates 27, 28, e.g. by machine screws 92. Pivotally mounted on brace member 91 is a blade support element 93 to which are attached a plurality of blade elements 94. The plurality of blade elements 94, which are secured to blade support element 93 in side-by-side abutting relationship across the full width of the apparatus as may be seen in FIG. 4, cooperate to define a saw tooth cutter capable of penetrating and cutting a web of material.

Also pivotally secured to the pivot on brace member 91 is a link arm 96. Link arm 96 is secured to blade support element 93 and is thus pivotable therewith around the pivot in brace member 91. Link arm 96, at its end distal from its connection to blade support element 93, is pivotally connected to the shaft 97 of a fluid motor, e.g. air motor 98. Air motor 98 is operatively mounted on the inner surface of first structural plate 27. In this regard, although only a single fluid motor is shown with respect to the operation of cutter 75, it will be recognized that an additional fluid motor operator may be provided if required, and mounted on the inner surface of second structural plate 28.

It will be evident from the foregoing that fluid motor 98 is operable to reciprocate its shaft 97 thereby, through link arm 96, to cause rotation of blade support element 93 and therewith blade elements 94, between a cutting position as shown in solid line in FIG. 2 and a retracted position as shown in broken lines in FIG. 2. It can also be seen from FIG. 2 that when lower cutting knife 75 is in cutting position the blade elements 94 thereof extend into and through the plane of the lower web of material as it passes generally from the lower web input rolls to the web output rolls.

Upper web cutting knife structure 85 also includes a transversely extending structural brace member 101 which is secured at its ends to structural plates 27, 28, e.g. by machine screws 102. Pivotally mounted on brace member 101 is a blade support element 103 to which are attached a plurality of blade elements 104. The plurality of blade elements 104, which are secured to blade support element 103 in side-by-side abutting relationship across the full width of the apparatus, cooperate to define a saw tooth cutter capable of penetrating and cutting the upper web of material.

Also pivotally secured to the pivot on brace member 101 is a link arm 106. Link arm 106 is secured to blade support element 103 and is thus pivotable therewith around the pivot on brace member 101. Link arm 106, at its end distal from its connection to blade support element 103, is pivotally connected to the shaft 107 of a fluid motor, e.g. air motor 108. Air motor 108 is operatively mounted on the inner surface of first structural plate 28. Further, as was the case with respect to the operator for lower blade cutter 75, an additional fluid motor operator may be provided.

Fluid motor 108 is operable to reciprocate shaft 107 thereby, through link arm 106, to cause rotation of blade support element 103 and therewith blade elements 104, between a cutting position as shown in solid line in FIG. 2 and a retracted position as shown in broken lines in FIG. 2. It is also clear from FIG. 2 that when upper cutting knife 85 is in cutting position the blade elements 104 thereof extend into and through the plane of the upper web of material as it passes generally from the upper web input rolls to the web output rolls.

There are two trap type doors associated with apparatus 10. The first, trap door 110, extends transversely between plates 27, 28 and is pivotable about a hinge pin 111 which is rigidly secured to and extends between plates 27, 28. Trap door 110 may be of relatively light sheet metal construction with suitable bracing. When in its closed position, as shown in solid line in FIG. 2, it rests against the upper transverse edge of upper web support plate 78 and is retained in the closed position by gravity which tends to rotate door 110 in the counter-clockwise direction around the axis of hinge pin 111.

As will be discussed below in detail, first trap door 110 serves to close an opening in the upper web support plate plane. It is provided to permit egress of a web clamp device which is utilized to position the fresh end of a top web to be spliced in the at-ready position for splicing.

Second trap door 114 similarly extends between plates 27, 28 and is pivotable about a hinge pin 115 which is rigidly secured to and extends between plates 27, 28. Trap door 114 may be of relatively light sheet metal construction with suitable bracing. When in its closed position as shown in solid line in FIG. 2, trap door 114 rests against the lower transverse edge of lower web support plate 69 and cooperates therewith to define a web support plane. Trap door 114 is operated between closed position and open position as shown in broken line in FIG. 2 by an air motor 116. Thus the shaft 117 of air motor 116 is connected to trap door 114 by a line 118 which passes over a pulley 119. When it is desired to open door 114 the air motor is operated to extend shaft 117 and cause the trap door to rotate around hinge pin 115 in the counter-clockwise direction. When it is desired to close trap door 114, the air motor 116 is operated to retract shaft 117 and through line 118 to cause the trap door 114 to rotate in the clockwise direction to its closed position.

As will become evident from a discussion of the operation of the apparatus, a fresh lower web is positioned through lower web input rolls manually by an operator. The structure of the apparatus and its operation, however, preclude the manual introduction of the leading end of a fresh top web during feeding of a bottom web.

Therefore the present apparatus includes means for carrying the leading edge of a fresh web of material into position for being spliced as a top web of material.

Considering therefore the top web feed apparatus and with particular reference to FIGS. 2, 3, 5 and 7, there is contained within web clamp casing 32 a web clamp and a web clamp advancing structure. The web clamp advancing structure comprises a plurality of sprockets and a pair of chains on which is mounted a web clamp 122. Web clamp 122 which is utilized in apparatus 10 is structured in accordance with the disclosure in my copending application, Ser. No. 853,240, filed Nov. 21, 1977 for WEB CLAMP.

Web clamp 122 is mounted on a pair of chains 123, 124 which are carried around a feeding cycle by driving sprockets 126, 127 and a plurality of idler sprockets as is discussed below in detail.

The various sprockets which comprise the support means for chains 123, 124 and thereby for web clamp 122, are mounted for rotational movement on the inner surfaces of structural support plates 27 and 28. Each sprocket mounted on plate 27 is matched by a corresponding sprocket mounted on plate 28, all for the purpose of maintaining the longitudinal axis of web clamp 122 (i.e. the axis of 122 which is transverse of apparatus 10) perpendicular to the direction of feed of the webs. In view of the correspondence of the respective sprockets and in particular the idler sprockets the structure of the idler sprockets will be described in terms of those mounted on the inner surface of first structural plate 27. For purposes of this disclosure with the exception of driving sprockets 126, 127, corresponding sprockets which are mounted on plate 28, transversely opposite the sprockets mounted on plate 27, will be designated by the same reference numeral and set off with a prime.

Thus, referring to FIG. 2 and with particular reference to the lower right hand portion of clamp casing 32, there is shown a return idler sprocket 129 which reverses the direction of chain 123 from leftward to rightward as shown in the drawing. Disposed upwardly and to the right of sprocket 129 is idler sprocket 130 which is utilized to redirect the direction of movement of chain 123 from horizontally to the right as seen in FIG. 2 to vertically as seen in FIG. 2.

From its change of direction as provided by sprocket 130, chain 123 travels vertically upwardly to idler sprocket 131 whereupon the direction of motion of chain 123 is redirected from upwardly to horizontally to the left. Chain 123 maintains its horizontal leftwardly oriented direction until it reaches idler sprocket 132 which redirects the chain from horizontally leftwardly to upwardly to the left at an angle of approximately 45°. Thereafter the direction of movement of chain 123 is altered from upwardly leftwardly to horizontally to the right by idler sprocket 134.

From idler sprocket 134, chain 123 continues horizontally to drive sprocket 126. Intermediate drive sprocket 126 and idler sprocket 134 there is provided an idler sprocket 136. The function of idler sprocket 136 is to provide interim support for chain 123 between idler 134 and drive sprocket 126 to preclude excessive sag in the chain which might result in failing of the apparatus.

Drive sprocket 126 not only provides motive power to chain 123 as is discussed below, it redirects the movement of chain 123 from horizontally to the right to vertically downwardly. Thus chain 123 moves downwardly from drive sprocket 126 to idler sprocket 138 where it is redirected from vertically downward movement to horizontal movement to the left. From idler sprocket 138 chain 123 passes to idler sprocket 129 whereupon its cycle recommences.

As is clearly disclosed in my copending application identified above, web clamp 122 is rigidly secured to chains 123, 124 by machine screws which extend through rivet bores in the respective chains and which are received in tapped bores formed in the web clamp. Thus, as chains 123, 124 are advanced, web clamp 122 is advanced therewith and travels with the chains throughout each complete cycle.

Disposed longitudinally between idler sprockets 131, 131' and top web input idler roll 49 is an intermediate idler roll 140. Idler roll 140 provides support for a top web of material being carried into the apparatus 10 by web clamp 122 and also assists in the alignment of the web for passage between top web input nip roll 48 and top web input idler roll 49.

Idler roll 140 is rotatably supported in bearings 142 which are mounted on vertical supports 144 depending from side walls 35 and 36 respectively.

Rigidly mounted on the outer surface of wall 38 is a motor 146 which is keyed to a shaft 147 extending transversely between walls 35 and 38 and rotatably mounted thereon such as by bearings. Sprockets 126, 127 are mounted on shaft 147 for rotation therewith and thus are driven by motor 146 through shaft 147.

Considering now the operation of apparatus 10 and with particular reference to FIGS. 7 through 15, it will be assumed initially that apparatus 10 is in operation with a bottom web 164 being the active web. More specifically, with bottom web 164 being the active web, the web material 164 is being unrolled from first roll 18 on first spool feed structure 14 to be fed through apparatus 10 and thereafter into finishing equipment 24. During the feeding of web 164, an operator must prepare a new top feed roll 20 on second spool feed structure 16. Such preparation occurs by removing the spent spool and mounting a fresh roll of material. In this regard the spool mounting structure may be any of the types generally known in these arts.

With a fresh top roll 20 disposed on second spool feed structure 16, the leading edge 154 of the fresh web 152 is positioned on web clamp 122 which is pre-positioned at position A as seen in FIG. 3. Positioning and preparation of the leading edge 154 of the fresh web is accomplished by an operator laying the fresh web on the main bar of clamp 122 and running a knife along the front edge of the bar to even the web edge. Thereafter the clamping element of the web clamp is operated to secure the web in position on the clamp all as disclosed in detail in my above-referenced copending application.

With the leading edge of web 152 so secured, the operator adhesively secures a strip 157 of double adhesive tape transversely across the full width of the web. It will be recognized by those skilled in these arts that such double adhesive tape comprises a strip of material having adhesive on its upper and lower surfaces and layers of release paper covering each of the adhesive layers. To apply the tape the operator strips the release paper from one adhesive surface and applies that surface to the surface of the leading edge 154 of web 152. With the adhesive properly positioned the remaining strip of release paper is removed and the web is thus physically prepared for the splicing operation.

After physical preparation is completed the leading edge 154 of web 152 must be transported to the correct position for commencement of the splicing operation.

This position is designated generally as position F in FIG. 7. Movement of the web from position A to position F is achieved by operation of the web clamp advancing structure. Thus, the web clamp advancing motor 146 is actuated causing drive sprockets 126 and 127 to drive chains 123 and 124 in the direction of the arrows as shown in FIG.

As web clamp 122 is moved through the various positions A through F as shown in the drawing, the leading edge 154 of web 152 is carried therewith. It should be noted that as web clamp 122 passes through positions C,D and E, the web is caused to wrap around idler roll 140. The vertical displacement between idler roll 140 and web clamp 122 is such as to insure that adhesive strip 157 does not come into contact with the idler roller. Clearly it will be recognized that such contact would cause strip 157 and therewith the leading edge 154 of the web to adhere to the roll and preclude proper splice positioning.

With the advancement of web clamp 122 to position F as seen in FIG. 7, the driving sprockets 126, 127 are stopped. This may be accomplished manually or by some automatic means. The specific mode of control, however, is not critical to the invention and may be provided in accordance with any of many known techniques. As web clamp 122 is stopped in position F, top web input nip roll 48 is advanced to operating position by air motor 51 to secure the web in position and the camming bar of the clamp is operated to release the leading edge of the web from the clamp grip. This having occurred driving sprockets 126, 127 are again operated to advance chains 123, 124, and web clamp 122 is carried through positions G and H back to position A where it is ready for the positioning of a next succeeding top web.

It should be noted at this time that as web clamp 122 is displaced from position F to position G (FIG. 7) its upper leading edge engages trap door 110 causing the trap door to pivot about pivot pin 111 from the position shown in solid lines in FIG. 2 to the position shown in broken lines in FIG. 2. Such movement of the trap door 110 permits egress of the web clamp from the path of the web. As the web clamp 122 passes from position G to be redirected by idler sprockets 134, 134', trap door 110 slips off the clamp and is caused by gravity to rotate in the counter-clockwise direction from the open position to the closed position.

The foregoing constitutes a description of how the leading edge 154 of a fresh top web 152 is positioned through the space between nip roll 48 and idler roll 49 such as to be ready for the splicing procedure. Prior to a description of the splicing cycles it would be well to describe how a bottom web is positioned and prepared in anticipation of the splicing cycle.

Assuming therefore that the top web 152 is the active web during operation of apparatus 10 and a bottom web has just expired, the empty bottom web spool is removed from first spool feed structure 14 and replaced with a fresh roll of web material. Lower trap door 114 is then rotated in a counter-clockwise direction from the position shown in solid line in FIG. 2 to the position shown in broken lines in FIG. 2 through the operation of fluid motor 116 as is discussed above so as to open the lower trap door. The fresh web material is then partially unrolled by an operator and the leading edge thereof is advanced through the opening between bottom web input idler roll 59 and bottom web input nip roll 58. The leading portion of the fresh web is then laid in surface-to-surface contact on the upper surface of lower trap door 114 and lower web input nip roll 58 is displaced from retracted to operating position to secure the lower web in this position.

The opening of first trap door 114 thus gives an operator access to the leading edge 162 of lower web 164 after it has been passed between the bottom web input rolls 58, 59. With the leading edge 162 of the web so positioned, the operator positions transversely across the upper surface of web 164 a strip of dual surface adhesive 166 in the same manner as discussed above with respect to adhesive strip 157. With the strip so positioned, the upper layer of release paper is removed to place the leading edge in physical condition for splicing and trap door 114 is closed by the operation of fluid motor 116.

Thus far there has been described the manner of physically and positionally preparing a lower web leading edge and a top web leading edge for splicing. Hereafter, therefore the splicing cycle will be described in detail from the point of view of splicing a fresh top web on the trailing edge of an exhausting bottom web and from the point of view of splicing a fresh bottom web on the trailing end of an expiring top web.

Figure 8:
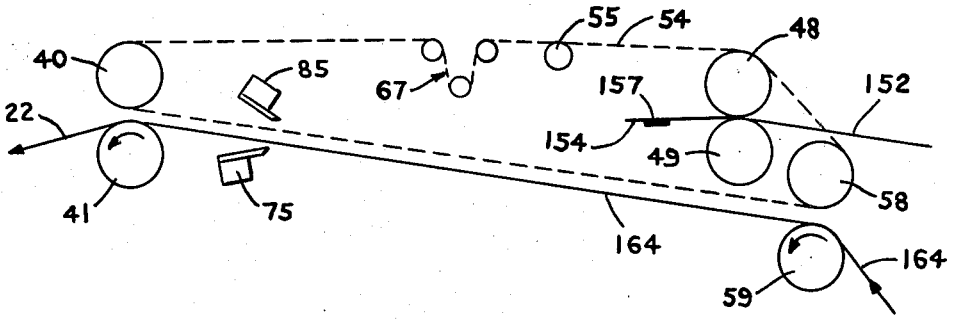
FIGS. 8 through 11 are front elevational schematic views of the operation of the apparatus according to the invention during acceleration and splicing of a fresh top web of material to an expiring bottom web of material.

Considering initially the splicing of the leading edge 154 of a fresh top web 152 to the trailing edge of an expiring bottom web, and with particular reference to FIGS. 8 through 11, there is shown in FIG. 8 a top web 152 of feed material positioned through top web input feed rollers 48, 49 with adhesive strip 157 positioned on the leading edge 154 with its exposed sticky surface facing downwardly. Lower web 164 is shown to be the active web, passing over lower web input idler roll 59 and output idler roll 41 out of the web splicing apparatus. During this "at ready" period nip rolls 40 and 58 are in the retracted position however nip roll 48 has been advanced as discussed above to clamp the web in position as shown.

Figure 9:
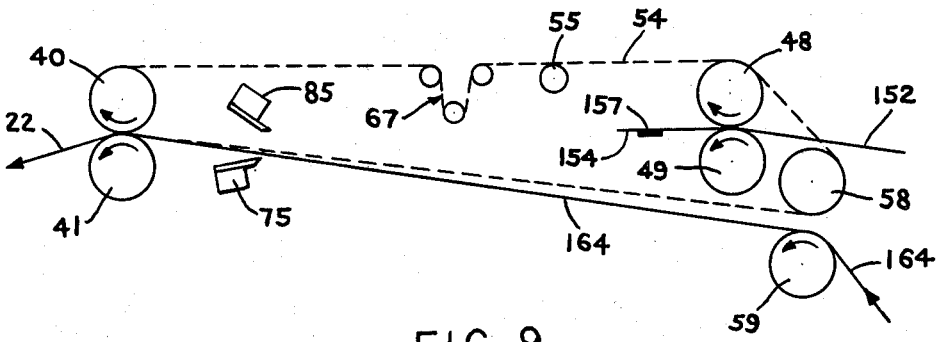
Figure 10:
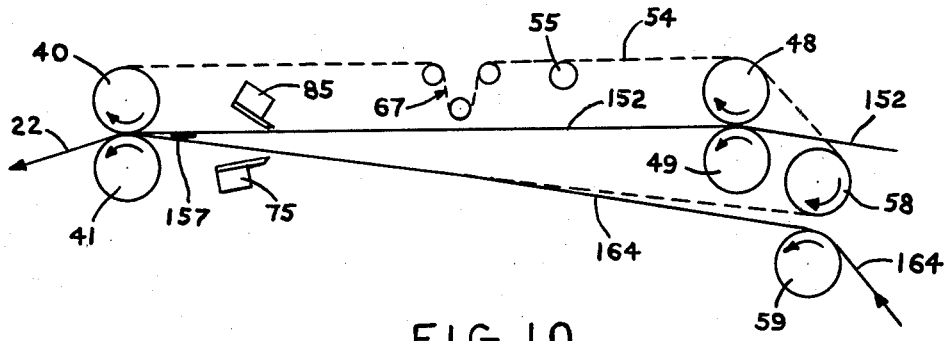

As the bottom feed web 164 approaches exhaustion the apparatus is armed for splicing. More specifically, an operator manually or a control system automatically may actuate the top web feed arming controls which cause fluid motors 42 to displace output nip roll 40 downwardly into operating position FIG. 9. With the apparatus in the armed position as shown in FIG. 9, output nip roll 40 is in surface-to-surface engagement with active advancing web 164 and is thus caused to rotate in the clockwise direction as shown by the arrow. No rotation is imparted to the other nip rolls, however, because clutch means 45 is disengaged and thus no movement from roll 40 is imparted through clutch 45 to its corresponding sprocket 53.

As the lower web 164 approaches exhaustion the operation manually or a control means may automatically actuate the splice cycle. Upon the occurrence of such activation the clutch means 45 is engaged thereby to commence an acceleration of nip rolls 48 and 58 through chain 54 and their associated sprockets 53 and 63. Although all three nip rolls are actuated and accelerated, lower web input nip roll effectively idles because, as best may be seen in FIG. 10, it has not been advanced into operating position during this portion of the cycle. It may also be noted that chain drive 54 may be provided with a one way clutch 55 to provide the possibility of wrong way movement of the web once the "at ready" position has occurred.

Clutch means 45 is an adjustable friction clutch which causes the gradual acceleration of the top web 152 from its "at rest" position during the "armed" phase of the cycle to its "at speed" velocity at the time of actual splicing. In this regard the clutch may be adjusted for the particular end speed and tensile strength of the material being fed such that the material may be accelerated without tearing. The actual clutch friction setting will be varied from job to job and although this feature forms a portion of the present invention the actual clutch adjustment may be made empirically during operation. Any of the many known adjustable friction clutches may be utilized including those which are adjustable manually, hydraulically, mechanically, pnematically or otherwise. It has been found, however, that a pnematically responsive clutch the regulation of air to which is achieved through an adjustable flow control from a regulated air space has been found to be particularly successful. This mode of control, although unique to the combination of elements as disclosed in this application, is known in the clutch art.

The leading edge 154 of fresh top web 152 achieves the same velocity of expiring web 164 just prior to both being passed together between output nip and idler rolls 40, 41. As the two webs are passed through the rolls the exposed sticky surface of adhesive strip 157 is pressed into contact with the upper surface of bottom web 164 as the two are thus adhesively joined together to form a web joint 168.

Figure 11:
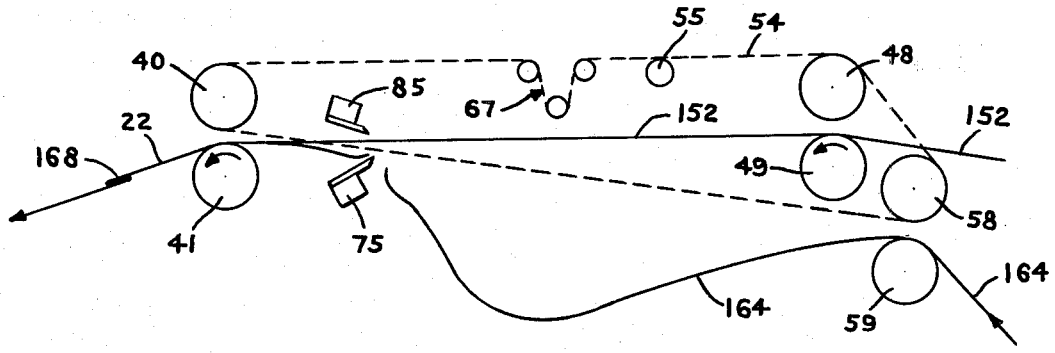

Upon clearance of web joint 168 from the apparatus, fluid motor 98 is actuated to cause rotation of lower cutting knife 75 into severing position and the trailing edge of exhausted lower web 164 is severed from the active position FIG. 11. Thus, the splice between the two webs of material is complete and top web 152 has become the active web without interrupting the operation of the downstream production line.

With the apparatus so operating the operator removes the tail of the exhausted bottom web and prepares for the splicing of a fresh bottom web upon the exhaustion of the now active top web 152 of material.

The first step in preparing a fresh bottom web is to remove the exhausted bottom spool from first spool feed structure 14 and place a fresh spool 18 of web material thereon. Thereafter trap door 114 is lowered around pivot 115 by the operation of fluid motor 117.

Bottom web input nip roll 58 is in the open position. Therefore the operator can take the leading edge 162 of the fresh bottom web 164 and pass it between the nip and idler bottom web input rolls 58, 59 so as to lay on the top surface of trap door 114. With the web of material so positioned, the operator advances nip roll 58 into operating position to hold the web and thereafter attaches to the web a strip 167 of double surfaced adhesive tap. This is achieved by removing one strip of release paper from the tap and extending it transversely across the leading edge of the web. With the tape correctly positioned the operator removes the release paper from its upper surface and operates fluid motor 116 to close trap door 114. With the bottom web so positioned it is in the "at ready" positioned and the apparatus and webs are in condition for commencement of the bottom web splice cycle.

Figure 12:
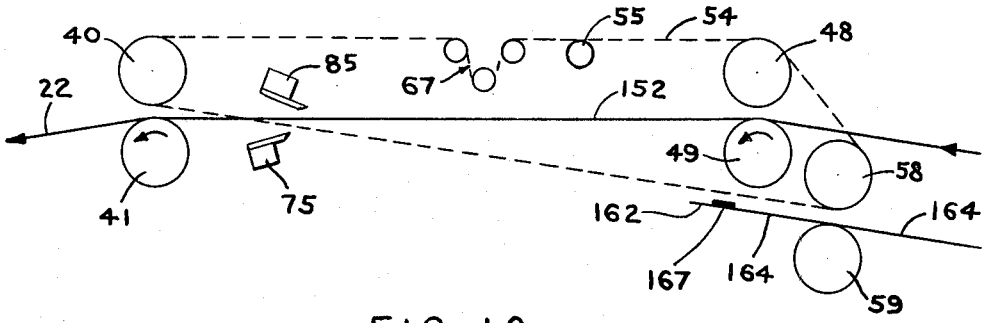
FIGS. 12 through 15 are front elevational schematic views of the operation of the apparatus according to the invention during acceleration and splicing of a fresh bottom web of material to an expiring bottom web of material.
Figure 15:
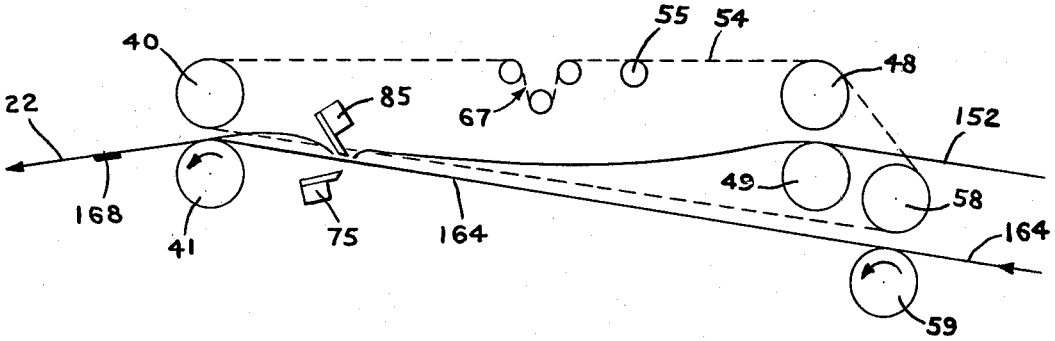

Referring therefore to FIGS. 12 and 15 and considering the splicing of the leading edge 162 of a fresh bottom roll of material to the trailing edge of an expiring top web, there is shown in FIG. 12 a bottom web 164 of feed material positioned through bottom web input feed rolls 58, 59 with adhesive strip 167 positioned on the web adjacent the leading edge. As noted above the upper surface of the tap 167 is without release paper so as to expose the sticky adhesive in anticipation of splicing. Upper web 152 is shown to be the active web, passing over upper web input idler roll 48 and output idler roll 41 out of the web splicing apparatus. During this "at ready" period neither of the respective nip rolls 40 and 58 have been advanced by their respective fluid motors to operating position. However, as noted above, nip roll 58 has been advanced to operating position in order to secure the web in position for having the adhesive material secured thereto.

Figure 13:
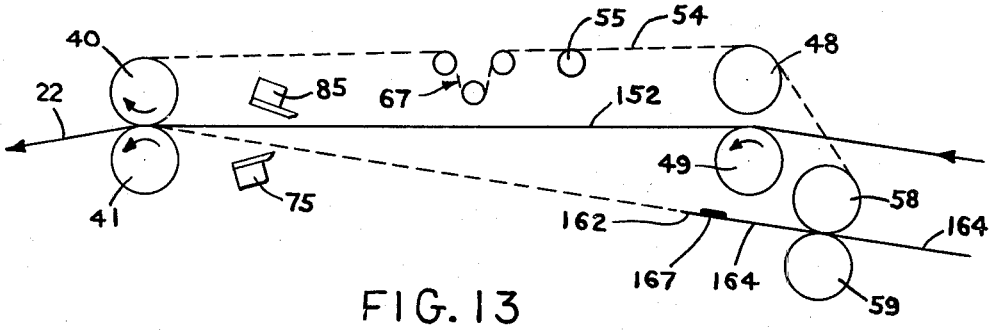
Figure 14:
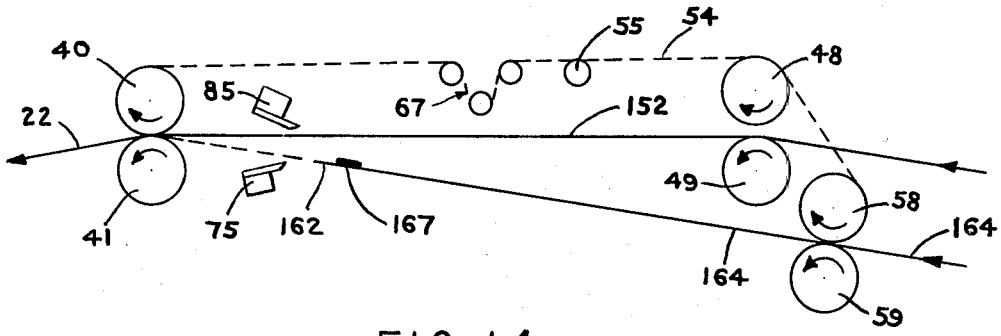

As the top web 152 approaches exhaustion, the apparatus is armed for splicing. More specifically, an operator manually or a control system automatically may actuate the bottom web feed arming controls which cause fluid motors 42 to displace output nip roll 40 downardly into operating position (FIG. 13). With the apparatus so in the armed position as shown in FIG. 13, output nip roll 40 is in surface-to-surface engagement with active advancing web 152 and is thus caused to rotate in the clockwise direction as shown by the arrow. No rotation is imparted to the nip rolls, however, because clutch means 45 is disengaged and thus no movement from roll 40 is imparted through clutch 45 to its corresponding sprocket 53.

As the top web 152 approaches exhaustion, the operator manually or a control means may automatically actuate the splice cycle. Upon the occurrence of such actuation the clutch means 45 is engaged thereby to commence an acceleration of nip rolls 48 and 58 through chain 54 and their associated sprockets 53 and 63. Although all three nip rolls are actuated and accelerated, upper web input nip roll 48 effectively idles because, at best may be seen in FIG. 14, it has not been advanced into operating position during this portion of the cycle.

As discussed above, friction clutch 45 will cause the gradual acceleration of the bottom web from its "at rest" position during the "armed" phase of the cycle to its "at speed" velocity at the time of actual splicing.

The leading edge 162 of fresh bottom web 164 achieves the same velocity as expiring web 152 just prior to both being passed together between output nip and idler rolls 40, 41. As the two webs are passed through the rolls, the exposed sticky surface of adhesive strip 167 is pressed into contact with the lower surface of the top web 152 and the two are thus adhesively joined together to form a web joint 168.

Upon clearance of web joint 168 from the apparatus, fluid motor 108 is actuated to cause rotation of upper cutting knife 85 into severing position and the trailing edge of exhausted top web 152 is severed from the active position, FIG. 15. Thus the splice between the two webs of material is complete and bottom web 164 has become the active web without interrupting the operation of the downstream production line.

Having completed severing of the tail of the exhausted top web, the operator may now remove the residual material and prepare the apparatus for a top feed splice when the bottom web material becomes exhausted. Further, upon the completion of a splice, all nip rolls 40, 48 and 58 as well as the respective upper and lower knives are returned to their inactive positions in order to permit passage of the web material to the apparatus unimpeded and solely over the respective idler rolls as appropriate.

It will be evident to those skilled in these arts that the above described apparatus for splicing webs of material together to form a continuous web for manufacturing and production purposes is a unique approach to a long-standing problem in this art.

Thus the described apparatus provides the ability to achieve top and bottom splicing without a need for expensive spool feed rotating apparatus and with a structure which is adaptable for use in existing apparatus and within the dimensional limitations of existing apparatus. The structure of the present invention is a simple structure having fundamental elements which cooperate in a unique manner to achieve the desired result.

It should be noted that the materials utilized for the manufacture of the apparatus may be conventional materials easily identifiable by those having ordinary skill in these arts. The chains, sprockets, fluid motors, pulleys and like equipment may all be selected from those generally available in the market place and readily identifiable by those having ordinary skill in these arts.

With respect to controls for the apparatus of the present invention, such controls may be manual i.e. push buttons and the like to be operated specifically by an operator; basic automatic i.e. controls which respond to time lapses and/or diameters of feed rolls; or the more highly complex sophisticated controls which have been utilized in the manufacturing industry. In this regard it should be recognized, however, that the particular manner of control or the equipment utilized therefor with respect to the cycle disclosed above regarding the present invention is not critical to the present invention. More specifically, the present invention is directed to the achievement of acceleration and splicing of webs of material wherein the fresh web may be handled either from a top web position or from a bottom web position without the necessity for expensive, bulky and difficult to utilize web feed apparatus.

Thus it can be seen from the foregoing detailed description of the preferred embodiment that the apparatus of the present invention constitutes an apparatus which achieves the above-defined objects as well as others not enumerated. It will be recognized by those skilled in these arts, however, that many modifications and variations may be made to the specific detailed embodiment without departing from the spirit and scope of the present invention.

What is claimed is:

1. Web handling apparatus for accelerating a first web of material to the speed of a moving second web of material, said apparatus comprising:

first roller means for accommodating the passage therebetween of said first web of material;

second roller means for accommodating the passage therebetween of said second web of material;

third roller means for receiving said first web of material from said first roller means and for receiving said second web of material from said second roller means, said third roller means for accommodating the passage therebetween of either of said first web of material individually, said second web of material individually or said first and second webs of material together; and means responsive to the operation of said third roller means for driving said first roller means to accelerate said first web of material to said speed of said second web of material.

2. Apparatus according to claim 1 wherein said means responsive to the operation of said third roller means includes clutch means.

3. Apparatus according to claim 1 including means for severing said second web of material, said means for severing being positioned between the locations of said second and third roller means.

4. Apparatus according to claim 1 wherein said third roller means operated in response to the passage of said second web of material therethrough.

5. Apparatus according to claim 2 wherein said third roller means includes a first output roll and a second output roll and wherein said clutch means is driven by said first output roll.

6. Apparatus according to claim 2 wherein said clutch means is adjustable to control the rate of acceleration of said first web of material.

7. Apparatus according to claim 5 wherein said first roller means includes a first feed roll and a second feed roll and wherein said first feed roll is driven by said clutch means.

8. Apparatus according to claim 7 wherein said first output roll includes a shaft rotatable therewith and said clutch means is mounted on said shaft, and further wherein said first feed roll includes a shaft rotatable therewith, and further including means connecting said clutch means and said shaft of said first feed roll for transmitting rotational movement from said clutch means to said shaft of said first feed roll.

9. Apparatus according to claim 8 wherein said first output roll is rotatable in response to the movement of said second web of material.

10. Apparatus according to claim 8 including means for advancing the leading edge of said first web of material between said first feed roll and said second feed roll.

11. Web handling apparatus for alternatively accelerating a first web of material to the speed of a moving second web of material wherein the first web of material is positioned over the second web of material and for accelerating a second web of material wherein the second web of material is positioned below the first web of material, said apparatus comprising:

first roller means for accommodating the passage therebetween of said first web of material;

second roller means for accommodating the passage therebetween of said second web of material;

third roller means for accommodating the passage therebetween of either of said first web of material individually, said second web of material individually or said first and second webs of material together, said third roller means being operational in response to the passage therebetween of said first web of material individually, said second web of material individually or said first and second webs of material together; and means responsive to the operation of said third roller means for driving said first and second roller means selectively to accelerate said first web of material or said second web of material to said speed of said moving web of material.

12. Apparatus according to claim 11 wherein said means responsive to the operation of said third roller means includes clutch means.

13. Apparatus according to claim 11 including means for advancing the leading edge of said first web of material through said first roller means.

14. Apparatus according to claim 11 including means for severing said first and second webs of material, said means for severing being positioned between the locations of said first and second roller means and said third roller means.

15. Apparatus according to claim 11 wherein said third roller means operates in response to the passage of said first or second webs of material therethrough.

16. Apparatus according to claim 12 wherein said third roller means includes a first output roll and a second output roll and wherein said clutch means is driven by said first output roll.

17. Apparatus according to claim 12 wherein said clutch means is adjustable to control the rate of acceleration of said first web of material.

18. Apparatus according to claim 12 wherein: said first roller means includes a first web nip roll and a first web idler roll, said second roller means includes a second web nip roll and a second web idler roll, and said third roller means includes an output nip roll and an output idler roll; said clutch means is driven by said output nip roll; and, said first web nip roll and said second web nip roll are driven by said clutch means.

19. Apparatus according to claim 18 including means for displacing said first and second web nip rolls toward and away from said first and second idler rolls, respectively, into and out of first and second roller means operating positions.

20. Apparatus according to claim 18 wherein said clutch means is adjustable to control the rate of acceleration of said first and second web nip rolls.

21. Apparatus according to claim 18 wherein: said output nip roll includes a shaft rotatable therewith and said clutch means is mounted on said shaft; each of said first and second web nip rolls includes a shaft; and, further including means connecting said clutch means and said shafts of said first and second web nip rolls for transmitting rotational movement from said clutch means to said shafts of said first and second web nip rolls.

22. Apparatus according to claim 21 including means for displacing said first and second web nip rolls toward said first and second web idler rolls, respectively, into web advancing operating positions, and away from said first and second web idler rolls into retracted positions, said first web nip roll being advanced into operating position to accelerate said first web while said second web nip roll being advanced into operating position to accelerate said second web while said first web nip roll is in retracted position.

23. Apparatus according to claim 22 including means for gaining access to said second web of material while said second web of material is positioned between said second roller means and said third roller means.

24. Apparatus according to claim 21 including means for displacing said output nip roll toward said output idler roll into operating position and away from said output idler roll into retracted position, said means for displacing said output nip roll for tending to compress said first and second webs of material as they pass between said output nip roll and said output idler roll either alone or together, and whereby said webs passing between said output nip roll and said output idler roll impart rotational movement to said output nip roll when said output nip roll is in operating position.

25. Apparatus according to claim 24 wherein said compression generated on said first and second webs of material cooperates therewith to effect joinder of said first and second webs of material.

26. Apparatus according to claim 17 and including a second clutch means for limiting the operation of said means responsive to the operation of said third roller means to drive said first and second roller means in a single direction.

27. Web handling apparatus for accelerating a first web of material to the speed of a moving second web of material, said apparatus comprising:

first roller means for accommodating the passage therebetween of said first web of material;

second roller means for accommodating the passage therebetween of said second web of material;

third roller means for accommodating the passage therebetween of either of said first web of material individually, said second web of material individually or said first and second webs of material together;

means responsive to the operation of said third roller means for driving said first roller means to accelerate said first web of material to said speed of said second web of material; and means for advancing the leading edge of said first web of material through said first roller means.

* * * * *